US010208487B1

(12) United States Patent
Kimmerle et al.

(10) Patent No.: US 10,208,487 B1
(45) Date of Patent: Feb. 19, 2019

(54) REMOVABLE PANELING SYSTEM FOR A SUBSTRATE

(71) Applicants: William R. Kimmerle, Hudson, OH (US); William L. Kimmerle, Hudson, OH (US)

(72) Inventors: William R. Kimmerle, Hudson, OH (US); William L. Kimmerle, Hudson, OH (US)

( * ) Notice: Subject to any disclaimer, the term of this patent is extended or adjusted under 35 U.S.C. 154(b) by 0 days.

(21) Appl. No.: 15/372,777

(22) Filed: Dec. 8, 2016

Related U.S. Application Data

(63) Continuation of application No. 15/280,415, filed on Sep. 29, 2016.

(60) Provisional application No. 62/235,117, filed on Sep. 30, 2015.

(51) Int. Cl.
*E04F 13/08* (2006.01)
*E04F 13/10* (2006.01)

(52) U.S. Cl.
CPC ..... *E04F 13/0882* (2013.01); *E04F 13/10* (2013.01)

(58) Field of Classification Search
CPC ..... E04F 13/0882; E04F 13/10
USPC ..... 52/202, 483.1, 511
See application file for complete search history.

(56) References Cited

U.S. PATENT DOCUMENTS 3,863,412 A * 2/1975 Bodycomb ..... E04B 2/7457 52/346
3,866,376 A * 2/1975 Nelsson ..... E04B 2/7401 52/241
4,068,428 A * 1/1978 Peterson, III ..... E06B 3/28 160/354
4,562,675 A * 1/1986 Baigas, Jr. ..... E06B 3/285 160/354
4,581,865 A * 4/1986 Miller ..... E06B 3/28 52/202
4,731,883 A * 3/1988 Foster ..... A41D 27/28 2/247
4,744,189 A * 5/1988 Wilson ..... B44C 1/28 40/908
5,144,786 A * 9/1992 Pacione ..... E04F 13/0882 52/511
5,656,351 A * 8/1997 Donaruma ..... A44B 18/0023 24/442
6,374,751 B1 * 4/2002 With ..... A47B 23/002 100/90
6,408,795 B1 * 6/2002 Goodger ..... A01K 31/04 119/469

(Continued)

OTHER PUBLICATIONS

Justin McCall, www.stikwood.com/collections/stikwood, website, publication date unknown.

*Primary Examiner* — Joshua K Ihezie
(74) *Attorney, Agent, or Firm* — Emerson Thomson Bennett, LLC

(57) ABSTRACT

Provided is a paneling system that may be applied to a substrate such as a wall or other surface. The paneling system comprises a plurality of panels each containing a fastener on the back side of the individual panels and a corresponding fastener connected to a substrate such as a wall. Connecting or interlocking the fastener positioned on the back side of a panel to a fastener positioned on a substrate such as a wall results in an established connection between the panel and the substrate or wall. To remove the installed panels from the substrate or wall, one simply pulls the panel off of the substrate to disconnect the fasteners from each other.

14 Claims, 13 Drawing Sheets

(56) References Cited

U.S. PATENT DOCUMENTS

| | | | | |
|---|---|---|---|---|
| 6,599,599 | B1 * | 7/2003 | Buckwater | A47G 27/0468<br>428/317.3 |
| 7,064,280 | B1 * | 6/2006 | Rodgers | H05K 9/0003<br>174/350 |
| 7,404,689 | B1 * | 7/2008 | Poling | A47G 27/0468<br>404/31 |
| 2014/0138332 | A1 * | 5/2014 | Loree | F16B 17/00<br>211/87.01 |
| 2015/0211236 | A1 * | 7/2015 | Bowden | E04F 13/0885<br>428/41.8 |

* cited by examiner

REMOVABLE PANELING SYSTEM FOR A SUBSTRATE

CROSS-REFERENCE TO RELATED APPLICATION

This application is a continuation of application Ser. No. 15/280,415, filed Sep. 29, 2016, which claims the benefit of U.S. Provisional Application No. 62/235,117, filed Sep. 30, 2015, the entirety of each of which are fully incorporated by reference herein.

BACKGROUND

A. Technical Field

This disclosure generally relates to a panel covering for a wall or other relatively flat surface. The panel covering may be fabricated from wood or other decoratively suitable material for application onto a surface.

B. Description of Related Art

Many individuals enjoy the aesthetic look of wood paneling within interior or exterior spaces of residential, commercial and other building structures. Installing a wood paneled wall, however, can be an expensive and labor intensive project. Moreover, once installed, the paneled wall essentially becomes a permanent fixture of the building structure. As such, should the paneled wall one day no longer be desired, a further expensive and labor intensive project would be required to remove the wood paneling to return the wall to its previous state. In some cases, this may involve a complete renovation requiring removal of the previous wall containing the wood paneling and installation of a new wall surface.

One method for installing wood paneling to walls is through the application of an adhesive to the wall and to the back side of the paneling. For example U.S. Pat. No. 3,750,728 discloses the use of pressure sensitive adhesive strips which may be used to install wood millwork such as wood trim molding around door openings. The pressure sensitive adhesive bonded to the planar underside of the molding. To activate the pressure sensitive adhesive, a protective film is removed to expose the adhesive surface. The back side of the molding is then applied to both the wall and the door jamb elements for installation. U.S. Pat. No. 3,969,558 discloses forming a sheet of wood veneer comprising a composite of individual flitches joined together by an adhesive. The sheet of veneer is then joined to a substrate by an adhesive. The substrate may consist of wood, plywood, particle board, hard board, paper, plastic sheet, cement board, ceramic board, metallic board, etc. The adhesive preferably consists of a thermoplastic resin that is applied through a hot gluing process. U.S. Pat. No. 4,421,808 discloses a roll of wallcovering having a wood grain design which is applied to a wall over a previously applied adhesive. In an alternative embodiment, the wallcovering strips may be formed with an adhesive on the back side for application onto a wall. The wallcovering itself may be a single ply or a plurality of laminated plies and may consist of a relatively thick paperboard of about 0.02 inch thickness and a decorative veneer play of about 0.0001 inch. U.S. Pat. No. 6,576,079 discloses wooden tiles containing an adhesive backing which may adhered to a floor or onto a wall or ceiling. U.S. Patent Publication No. 2011/0104485 discloses a self-adhesive for a wood board (e.g., plywood, particle boards and fiber boards). The adhesive is formed of a polyolefin film containing reactive groups which interact with —OH groups within the wood to form a self-adhesive. The self-adhesive material may be applied to the wood as a coating or as a glue-line material to join veneers to the wood board. U.S. Patent Publication No. 2013/0186029 discloses a wall panel system that includes of a series of interlocking wall panels comprised of wood. The panels contain a pressure adherent backing or adhesive that readily bonds to wood and to a variety of surfaces such as conventional wall board or gypsum. A backing sheet may cover the adhesive and be removed prior to application of the panel system onto a wall.

The use of an adhesive to install a paneling system onto a wall, however, has several disadvantages. First, the adhesive provides a permanent means of fixing the paneling system to the wall. As such, removal of the paneling system from the wall may be extremely difficult if not, impossible as it would ultimately result in damaging the substrate or wall requiring removal and replacement of the entire substrate or wall. This can result in an extremely expensive and labor intensive endeavor that individuals may not be willing to do or even able to afford. In such situations, individuals would likely have very little choice but to remain with a wall paneling that they are not happy with. Second, traditional wood paneling for walls require a significant amount of labor and materials to make. This is especially the case if the paneling system must be customized for a specific wall. Moreover, installation of traditional wood paneling alone involves the labor intensive process of locating studs and nailing of the paneling system to the wall. In addition, the costs of traditional wood paneling for walls can be very expensive given the materials involved and the amount of customization desired. Consequently, wood paneled walls are often financially out reach for many consumers.

What is needed is a wood paneling system that solves the problems mentioned above including a system which can be easily applied and removed from a substrate or wall with a minimal amount of labor and without damaging the underlying substrate or wall and a paneling system which is relatively inexpensive to purchase.

SUMMARY

Provided is a paneling system for a substrate. The paneling system includes a plurality of individual panels having a front side, a back side, a top edge, a bottom edge, a first side edge, and a second side edge; a first fastener connected to the back side of the individual panels and a second fastener connected to the substrate. The individual panels are attached to the substrate through a connection established between the first fastener and the second fastener oriented with respect to one another in a unique pattern or a special pattern that may have favorable attributes as discussed below.

Also provided is a method for installing a paneling system onto a substrate. The method includes the following steps: obtaining a plurality of individual panels having a front side, a back side, a top edge, a bottom edge, a first side edge, and a second side edge, wherein the individual panels have a first fastener connected to the back side of the individual panels; installing a plurality of second fasteners onto the substrate; and pressing the individual panels to the wall to establish a connection established between first fastener and the second fastener, wherein the first fastener and the second fastener are oriented perpendicular to each other when connected.

DETAILED DESCRIPTION

Figure 1:
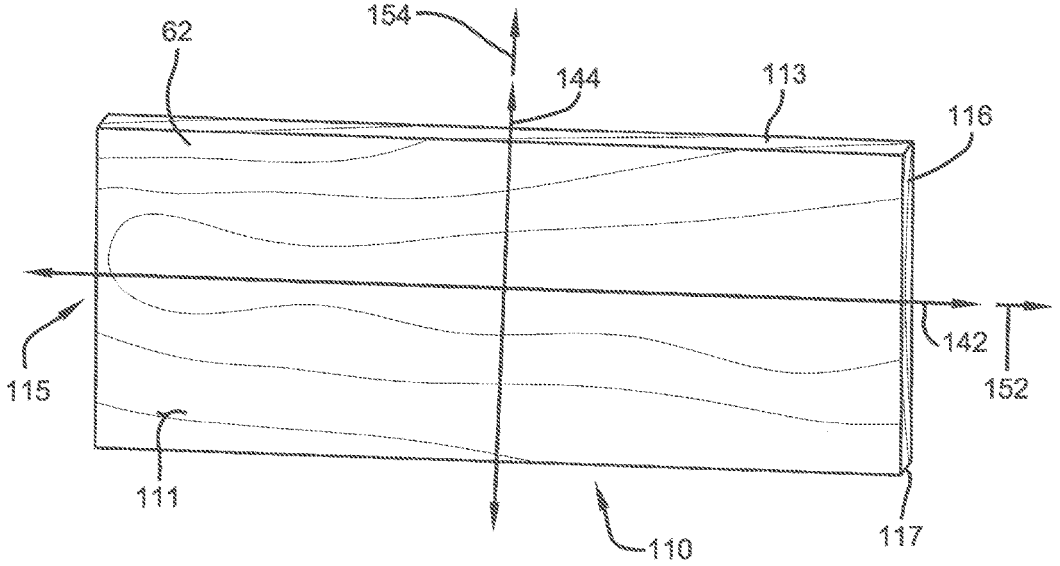
FIG. 1 is a perspective view of a front side of an exemplary rectangular panel.

Provided is a paneling system 100 that may be applied to a substrate 50 such as a wall 52 or other surface such as a floor or ceiling 54. The paneling system may be applied to interior or exterior surfaces and may be used within residential units, commercial buildings, offices or any other type of building structure.

The paneling system 100 is comprised of a plurality of panels 110 having a front side 111, a back side 112, a top edge side 113, a bottom edge side 114, a first edge side 115, and a second edge side 116. The panels 110 are typically comprised of wood although any type of materials (e.g., plastics) which are aesthetically pleasing to the individual and lightweight may be used to fabricate the panels 110. In certain embodiments, the panels 110 are fabricated from reclaimed wood 62 and may be connected with fasteners creating a unique pattern or a special pattern 360 that may have favorable attributes as discussed below.

The individual panels 110 of the paneling system 100 may be fabricated into various sizes. For example, in certain embodiments, and without limitation the individual panels 110 of the paneling system 110 may be fabricated into sizes of a generally rectangular shape having a length of between about 25 centimeters to 112 centimeters and a width of about 12.8 centimeters. For example, in certain embodiments, the individual panels of the paneling system may be fabricated into sizes of a generally rectangular shape having a length of about 50 centimeters, a width of about 12.8 centimeters and a thickness of about 5 mm. However, the individual panels 110 may be formed into any size and shape that is desired or required within the industry. The panels 110 themselves are lightweight and do not cause a significant load to the wall or substrate 50 to which they are applied. In other words, the load on the wall or substrate 50 caused by the panels is minimal. The individual panels 110 also have a thickness ranging from about 2 to about 6 millimeters. In certain embodiments, the thickness 117 of the panels is about 4 millimeters.

The paneling system 100 of the present disclosure is designed so that it can be easily installed onto a substrate 50 such as a wall 52 without having to undertake a project encompassing significant renovation or remodeling. Installation of the panels 110 does not require the hiring of a professional contractor. Rather, the individual purchaser of the panels 110, home or business owner, interior or exterior designer simply applies the paneling system 100 to a wall 52 or other substrate 50. The paneling system 100 sticks to the wall or other substrate 50 immediately with ease. Removal of individual panels 110 from the wall or other substrate 50 is accomplished as simply as installation, that is, by simply pulling the individual panels 110 off from the wall or other substrate 50. This allows an individual many options with respect to room or building structure design including the option to change the wall paneling pattern, remove the paneling system 100 from the wall or substrate 50, and possibly replace the paneling system 100 on the wall or substrate 50 with a more personally aesthetically pleasing paneling system 100 without causing any damage to the wall or substrate 50.

The individual panels 110 of the paneling system 100 may be installed onto a wall or other substrate 50 through the use of a fastener 120. In certain embodiments, the fastener 120 is a fabric hook and loop fastener. Hook and loop fasteners 122, 126 are also known as hook and pile fasteners or touch fasteners. These fasteners 122, 126 consist of two lineal fabric strips 130. The lineal fabric strips 130 have a front side 131 and a back side 132, a top edge 133, a bottom edge 134, a first side edge 135 and a second side edge 136. Each of these fabric strips are attached to opposing surfaces which are to be fastened to one another. A first fabric strip 122 is composed of a plurality of hooks 210 while the second fabric strip 126 is composed of a plurality of loops 320. The plurality of hooks 210 are generally positioned on the front side 131 of either the first or second fabric strips 130. Likewise, the plurality of loops 310 are generally positioned on the front side 131 of the opposite fabric strip, i.e., on either the first or second fabric strip 130. When the first and second fabric strip 110 are pressed together, the hooks 210 catch within the loops 320 causing the pieces to which the first and second fabric strips 130 are adhered to fasten together. Such fasteners are often referred to as Velcro®.

Figure 2:
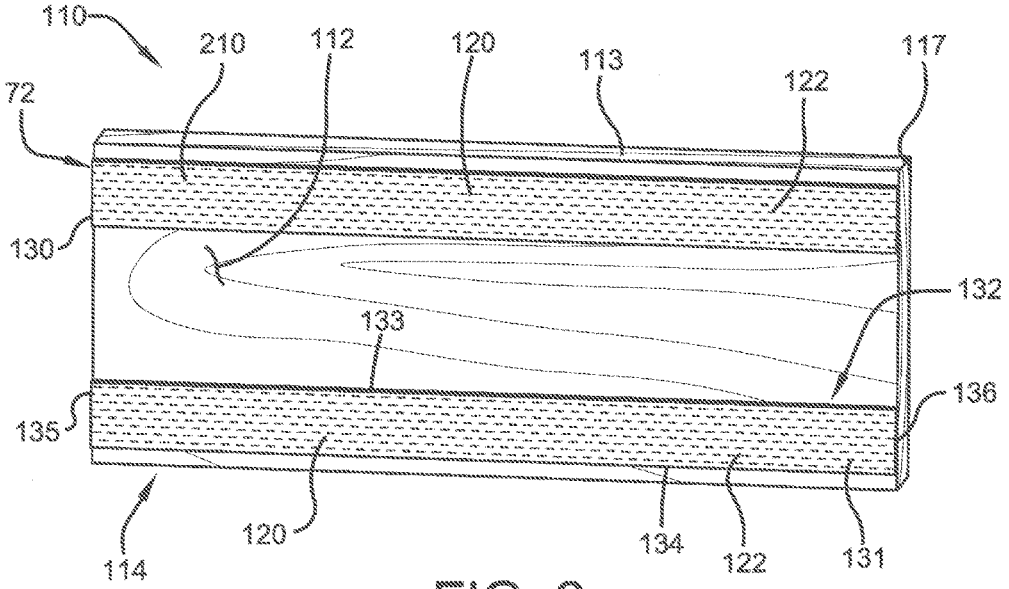
FIG. 2 is a planar view of a back side of an exemplary rectangular panel.
Figure 3:
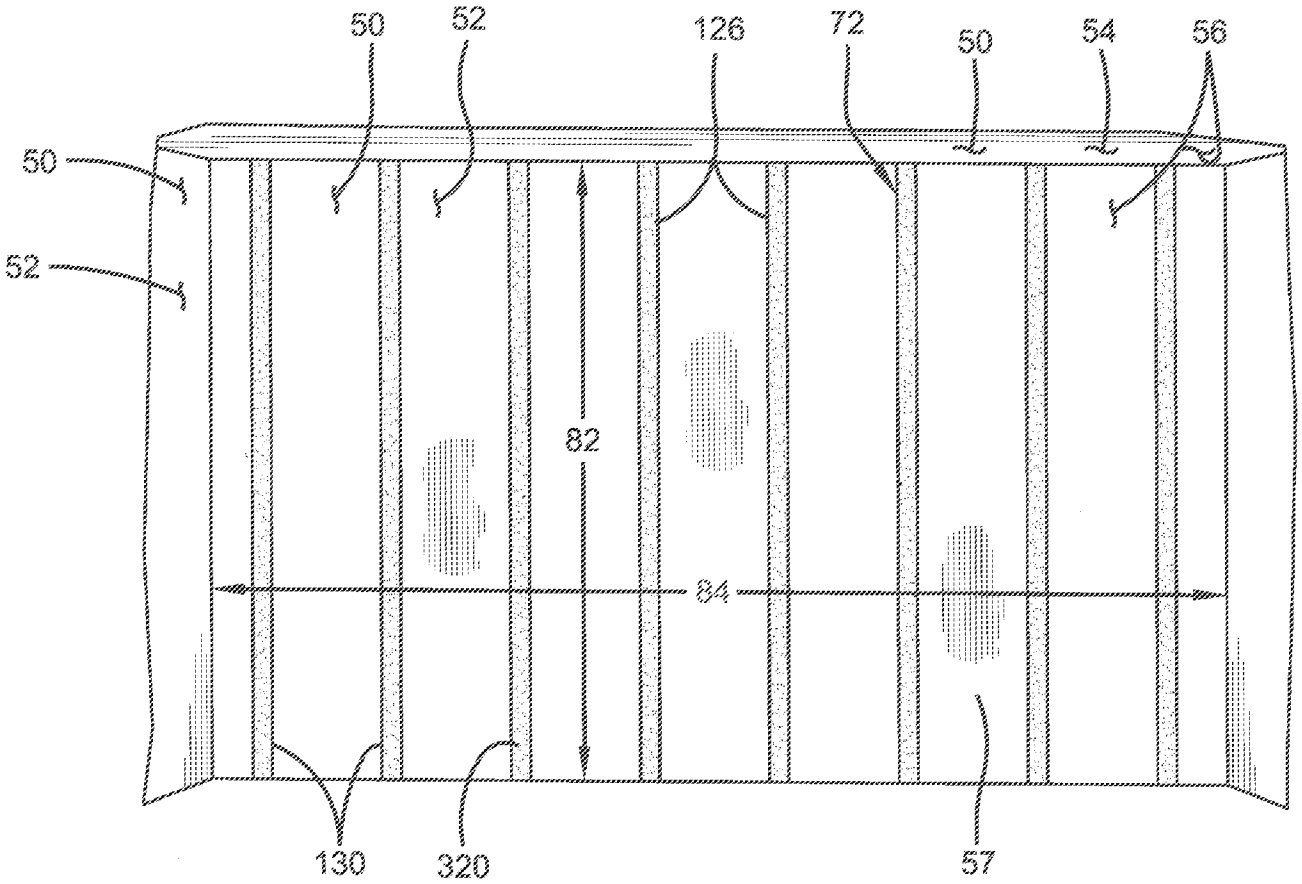
FIG. 3 is a planar view of an exemplary wall containing a plurality of longitudinal columnar fasteners installed thereon.

The hook and loop fastener 120 is attached to the back side 112 of the individual panels 110 of the paneling system 100 and to the surface 56 of the wall or substrate 50. Either the hook side or the loop side of the hook and loop fastener 122, 126 may be attached to the back side 112 of the individual panels 110. An example of this is shown in FIG. 2. Likewise, either the hook side or the loop side of the hook and loop fastener 120 may be attached to the surface 56 of the wall or substrate 50. An example of this is shown in FIG. 3. The connection 330 established between the hook and loop fasteners 122, 126 is sufficiently strong to allow the individual panels 110 of the paneling system 100 to be fastened to a wall 52 or other substrate 50 such as a ceiling 54 without having to worry about the individual panels 110 falling off from the wall or substrate 50.

In certain embodiments, the hook and loop fastener 120 may be attached to the back side 112 of the individual panels 110 of the paneling system 100 and to the wall 52 or other substrate 50 through the use of an adhesive 72. To accomplish this, an adhesive 22 is typically applied to the back side 112 of the individual hook and loop fasteners 122, 126. The individual hook and loop fasteners 122, 126 are then applied to the back side 112 of the individual panels 110 and to the wall or other substrate 50 by contacting the back side 112 of the hook and loop fasteners 122, 126 to the back side 112 of the individual panels 110 and to the surface 56 of the wall or other substrate 50. In certain embodiments, the strength of the adhesive 72 used to adhere either the hook or loop fastener 120 to a wall or other substrate 50 is relatively low so that removal of the hook or loop fastener 120 from the wall or other substrate e does not cause damage to the paint 57 or underlying drywall should the fastener 120 be pulled off of the wall or other substrate 50. In this regard, the adhesive 72 used to connect the hook and loop fastener 120 to a wall or other substrate 50 or to the individual panels 110 may be said to have a certain degree of non-stickiness. On the other hand, the adhesive 72 also has a strength which is sufficient to secure the hook and loop fasteners 120 to individual panels 110 and wall or other substrate. This is accomplished through the permanent nature of the adhesive 72. The adhesive's permanent nature also allows for other advantages. First, the adhesive's permanent nature also allows the individual panels 110 of the paneling system 100 to be fastened to a wall or other substrate 50 such as a ceiling without having to worry about the individual panels 110 falling off from the substrate 50. Second, the adhesive 72 is also sufficiently strong to keep either the hook or loop fastener 120 secured to the individual panels 110 and either the hook or loop fasteners 120 secured to the wall or other substrate 50 during the application of human force to pull the individual panels 110 off from the wall or substrate 50. An example of an adhesive 72 which possesses these multiple properties is an ultra-removable adhesive such as Appleton digital pressure sensitive having 3.4 mil clear vinyl top coat/80# zero split liner description. This type of adhesive is top coated with clear vinyl and optimized for HP Indigo presses and for use in high heat, dry toner-based equipment. It is an emulsion acrylic ultra-removable adhesive having moderate tack on flat smooth surfaces such as glass, counter tops, painted metal, smooth and textured walls and stainless steel. It also contains a liner which is a clay-coated bleached kraft lay-flat liner designed for sheet applications. In certain embodiments, this includes any adhesive with a high shear strength and a low peel strength.

In certain embodiments, the hook and loop fastener may be attached to the back side of the individual panels of the paneling system and to the wall or other substrate through the use of adhesives. The hook material, which is applied to the back of the panels utilizes a permanent adhesive. The loop material, which is applied to the wall (the surface which the panels are going to cover) utilize a non-permanent adhesive. In certain embodiments, the strength of the adhesive used to adhere either the loop fastener to a wall or other substrate is relatively low so that removal of the loop fastener from the wall or other substrate does not cause damage to the paint or underlying drywall should the fastener be pulled off of the wall or other substrate. In this regard, the adhesive used to connect the loop fastener to a wall or other substrate or to the individual panels may be said to have a certain degree of non-stickiness. On the other hand, the adhesive used on the panels is of a more permanent nature and has a strength which is sufficient to secure the hook fasteners to individual panels permanently and is extremely sticky. This is accomplished through the permanent nature of the adhesive. The unique combination of using permanent adhesive on the hook (applied to the panel) and non-permanent adhesive on the loop (applied to the wall) allows the individual panels of the paneling system to be fastened to a wall or other substrate such as a ceiling without having to worry about the individual panels falling off from the substrate. Second, the combination of adhesives used on the hook and loop materials respectively provide a bond that is sufficiently strong to keep the hook fastener permanently secured to the individual panels and the loop fasteners temporarily secured to the wall. In the case of the loop material, an example of an adhesive which possesses these properties is an ultra-removable adhesive such as Appleton digital pressure sensitive having 3.4 mil clear vinyl top coat/80# zero split liner description. This type of adhesive is top 5 coated with clear vinyl and optimized for HP Indigo presses and for use in high heat, dry toner based equipment. It is an emulsion acrylic ultra-removable adhesive having moderate tack on flat smooth surfaces such as glass, counter tops, painted metal, smooth and textured walls and stainless steel. It also contains a liner which is a clay-coated bleached kraft lay-flat liner designed for sheet applications. There are numerous types of ultra-removable adhesive loop materials that this embodiment includes.

Installation of the paneling system is relatively simple. For example, to install the paneling system onto a wall, an individual installer would first adhere the back side of either a hook or loop fastener onto a wall with an ultra-removable adhesive similar to the one described above in a vertical fashion from the top of the wall to the bottom of the wall, in other words, along the height of the wall. In certain embodiments, this may be accomplished by first removing a protective strip that covers the adhesive on the back side of the loop fastener that is to be installed onto the wall. In certain embodiments, this may be accomplished by first removing a protective strip that covers the adhesive on the back side of the loop fastener that is to be installed onto the wall. The installer would then repeat this process, creating multiple vertical columns of fastener material adhered along the height of the wall and spanning from one end of the wall to the other. Each vertical column of fastener adhered onto the wall is spaced at a specific interval. In some non-limiting embodiments, the specific interval may be approximately 25 centimeters. In certain embodiments, the spacing or distance between each vertical column of fastener is shorter than the shortest length of the individual panels. In other embodiments, the spacing or distance between each vertical column of fastener is longer than the length of the individual panels but allows for an overlapping section between the vertical column fasteners and the ends of the panel installed thereon. Any number of vertical columns of fastener may be installed onto the wall as is deemed necessary for the installation process. It is also contemplated that the vertical columns may span the entire height of the wall or a portion of the height of the wall depending on the portion of the wall that is desired to be covered with paneling. The columns of vertical fastener adhered to the wall essentially create what can be referred to as fastener studs onto which an opposing hook or loop fastener adhered to the back side of a panel can be connected to. FIG. 3 illustrates an exemplary wall having a vertical plurality of columns of fastener material installed which spans the entire height of the wall creating a unique pattern or a special pattern that may have favorable attributes as discussed below.

After the vertical columns of fastener material or strips are adhered to the wall, the installer simply attaches the panel containing strips of a corresponding opposing fastener (i.e., containing either a hook or loop fastener) directly and longitudinally onto the vertical column fasteners previously installed onto the wall. In such embodiments, the strips of fastener material on the back side of the panel are positioned in such a manner so as to be parallel ho horizontal with the length of the panel. This allows the fastener on the back side of the panel to be perpendicular with the vertical column fastener installed on the wall when connected together. This is illustrated within FIG. 4 which shows how a fastener on the backside of a particular panel attaches between the vertical columns of fastener material. In certain cases, this perpendicular connection 330 between the hook and loop fasteners provides the strongest connection 330 between the fasteners. In other cases, a perpendicular connection 330 between the hook and loop fasteners is not required. The fastener material installed on the back side of the panel may span the entire length of the panel or a portion of the entire length of the panel. Also, it is contemplated that one or more rows of fastener material may be installed on the back side of the panel. For example, in certain embodiments, two or three rows of fastener material may be installed horizontally along the length of the back side of the panels. In certain embodiments, and without limitation, the orientation of the fastener applied to the wall combined with the opposing fastener applied to the panel creates a unique pattern or a special pattern 360 wherein the angle between the orientation of the fastener applied to the wall and the orientation of the fastener applied to the panel is within the range of about 10 degrees to about 170 degrees. In certain embodiments this unique pattern or a special pattern 360 has favorable attributes which may include: 1) simplifying removal of the panels without damaging them, in contrast to embodiments in which the entire panel and wall are covered with hook or loop material, and in contrast to those embodiments in which a larger fraction of the panel and wall are covered with hook or loop; 2) reduction of the overall weight of material being hung on the wall; 3) improved application efficiency to both the wall and the panel which may reduce or minimize cost by efficient use of expensive connector material; or 4) some combination of the latter attributes.

In some non-limiting embodiments, after the vertical columns of loop fastener material or strips are adhered to the wall, the installer simply attaches the panel containing strips of hook directly and at a 90 degree angle to the vertical column loop fasteners previously installed onto the wall. In such embodiments, the strips of hook fastener material on the back side of the panel are positioned in such a manner so as to be parallel or horizontal with the length of the panel (but orthogonal to the loop material on the wall). This allows the fastener on the back side of the panel to be perpendicular with the vertical column loop fastener installed on the wall when connected together. This is illustrated within FIG. 4 which shows how a fastener on the backside of a particular panel attaches between the vertical columns of fastener material. In certain cases, this perpendicular connection between the hook and loop fasteners provides the strongest connection between the fasteners. In other cases, a perpendicular connection between the hook and loop fasteners is not required. The hook fastener material installed on the back side of the panel may span the entire length of the panel or a portion of the entire length of the panel. Also, it is contemplated that one or more rows of hook fastener material may be installed on the back side of the panel. For example, in certain embodiments, two or three rows of hook fastener material may be installed horizontally along the length of the back side of the panels.

The panels may be fabricated with either a hook or loop fastener pre-installed on the back side of the panels. However, it is also contemplated that panels may be sold without the hook or loop fastener installed on the back side of the panels. In such cases, the hook or loop fastener may installed onto the back side of the panels by the individual installer. In this embodiment, the individual installer would connect either the hook or loop fastener to the panel through an adhesive on the back side of the fastener. In certain embodiments, this may be accomplished by first removing a protective strip that covers the adhesive on the back side of either the hook or loop fastener that is to be installed onto the back side of the panels.

In some non-limiting embodiments, the panels may be fabricated with hook fastener pre-installed on the back side of the panels. However, it is also contemplated that panels may be sold without the hook fastener installed on the back side of the panels. In such cases, the hook fastener may installed onto the back side of the panels by the individual installer. In this embodiment, the individual installer would connect either the hook fastener to the panel through an adhesive on the back side of the fastener. In certain embodiments, this may be accomplished by first removing a protective strip that covers the adhesive on the back side of either the hook fastener that is to be installed onto the back side of the panels.

In embodiments where the individual panels of the paneling system are rectangular in shape, the panels have a length that is longer that its width. An example of a rectangular shaped panel is illustrate within FIG. 1. In such cases, the panels may be positioned horizontally on the wall with the length side of the panels oriented so that they run horizontally with the wall. Such panels are connected to the wall by pressing the panels onto the wall so that the hook and loop fasteners on the back side of the panel and on the wall connect to each other. As a result of the above-referenced unique fastener patterning or special fastener patterning, each panel may connect to the fasteners on the wall at least two points between the two longitudinal columnar fasteners. However, it is also contemplated that each panel may be connected to the two longitudinal columnar fasteners on the wall at four points, six points, etc. depending on the number of fasteners positioned on the back side of the panel. For example, a panel containing two rows of fasteners would be connected at four points between two longitudinal columnar fasteners and a panel containing three rows of fasteners would be connected at six points between two longitudinal columnar fasteners. It is also contemplated that a panel may also contain an odd number (e.g., one, three or more) of points of contact to the wall depending on the particular shape and design of the panel.

In certain embodiments where the individual panels of the paneling system are rectangular in shape, the panels have a length that is longer that its width. An example of a rectangular shaped panel is illustrate within FIG. 1. In such cases, the panels may be positioned horizontally on the wall with the length side of the panels oriented so that they run horizontally with the wall. Such panels are connected to the wall by pressing the panels onto the wall so that the hook fasteners on the back side of the panel and the loop fasteners on the wall connect to each other. Each panel may connect to the loop fasteners on the wall at least one point between the two longitudinal columnar fasteners. However, it is also contemplated that each panel may be connected to the two longitudinal columnar loop fasteners on the wall at, two points, three points, four points, six points, etc. depending on the number of fasteners positioned on the back side of the panel. For example, a panel containing two rows of fasteners would be connected at a minimum of two points on the longitudinal columnar loop fasteners and a panel containing three rows of fasteners would be connected at a minimum of three points on the longitudinal columnar loop fasteners. It is also contemplated that a panel may also contain an odd number (e.g., one, three or more) of points of contact to the wall depending on the particular shape and design of the panel.

Figure 5:
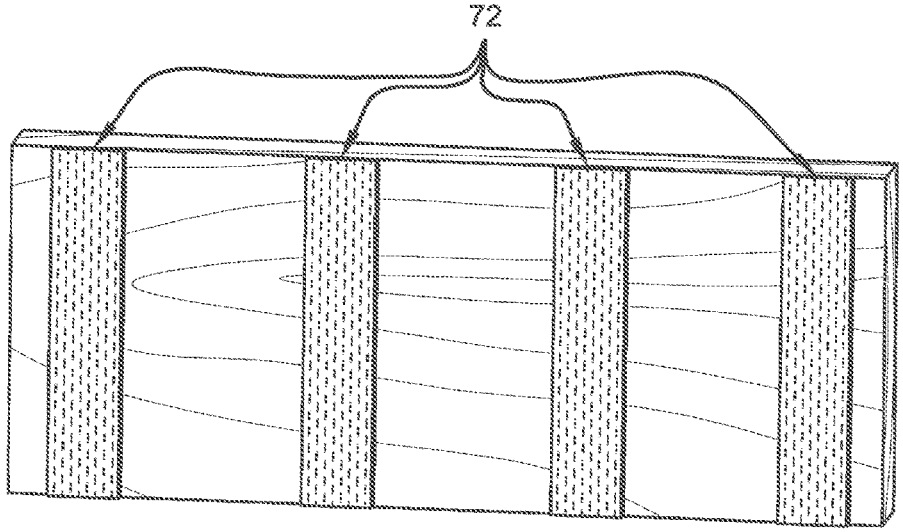
FIG. 5 is a planar view of a back side of a further exemplary rectangular panel.

In further embodiments, a rectangular-shaped paneling system having a length that is longer that its width may be positioned horizontally on a wall containing a plurality of horizontal rows of fastener material. In such cases, the back side of the panels contain longitudinal or vertical columns of fastener material and the length side of the panels and oriented so that they run horizontally with the wall. This orientation of the fasteners on the back side of the panel and on the wall ensures a perpendicular connection between the corresponding fasteners when the panels are installed vertically onto the wall. An example of such an embodiment is illustrated within FIGS. 5 through 7.

In further embodiments, a rectangular-shaped paneling system having a length that is longer than its width may be positioned horizontally on a wall containing a plurality of horizontal rows of fastener material. In such cases, the back side of the panels contain longitudinal or vertical columns of hook fastener material and the length side of the panels and oriented so that they run horizontally with the wall. This orientation of the hook fasteners on the back side of the panel and on the wall ensures a perpendicular connection between the corresponding loop fasteners when the panels are installed vertically onto the wall. An example of such an embodiment is illustrated within FIGS. 5 through 7.

In further embodiments, a rectangular-shaped paneling system having a length that is longer that its width may be positioned vertically on a wall with the length side of the panels oriented so that they run vertically with the wall. In embodiments where the panels are positioned vertically on the wall, it is contemplated back side of the panels may have the fasteners positioned so that they run parallel or horizontal with the width of the panel and the fasteners on the wall may be positioned so that they run horizontally along the length of the wall from a first end of the wall to a second end of the wall at various points of height on the wall. This orientation of the fasteners on the back side of the panel and on the wall ensures a perpendicular connection between the corresponding fasteners when the panels are installed vertically onto the wall. In other embodiments, a perpendicular connection between the fasteners for panels installed vertically onto a wall need not be established.

In certain further embodiments, a rectangular-shaped paneling system having a length that is longer that its width may be positioned vertically on a wall with the length side of the panels oriented so that they run vertically with the wall. In embodiments where the panels are positioned vertically on the wall, it is contemplated back side of the panels may have the hook fasteners positioned so that they run parallel or horizontal with the width of the panel and the loop fasteners on the wall may be positioned so that they run horizontally along the length of the wall from a first end of the wall to a second end of the wall at various points of height on the wall. This orientation of the hook fasteners on the back side of the panel and loop fasteners on the wall ensures a perpendicular connection between the corresponding fasteners when the panels are installed vertically onto the wall. In other embodiments, a perpendicular connection between the hook fasteners for panels installed vertically onto loop fasteners on a wall need not be established.

Figure 4:
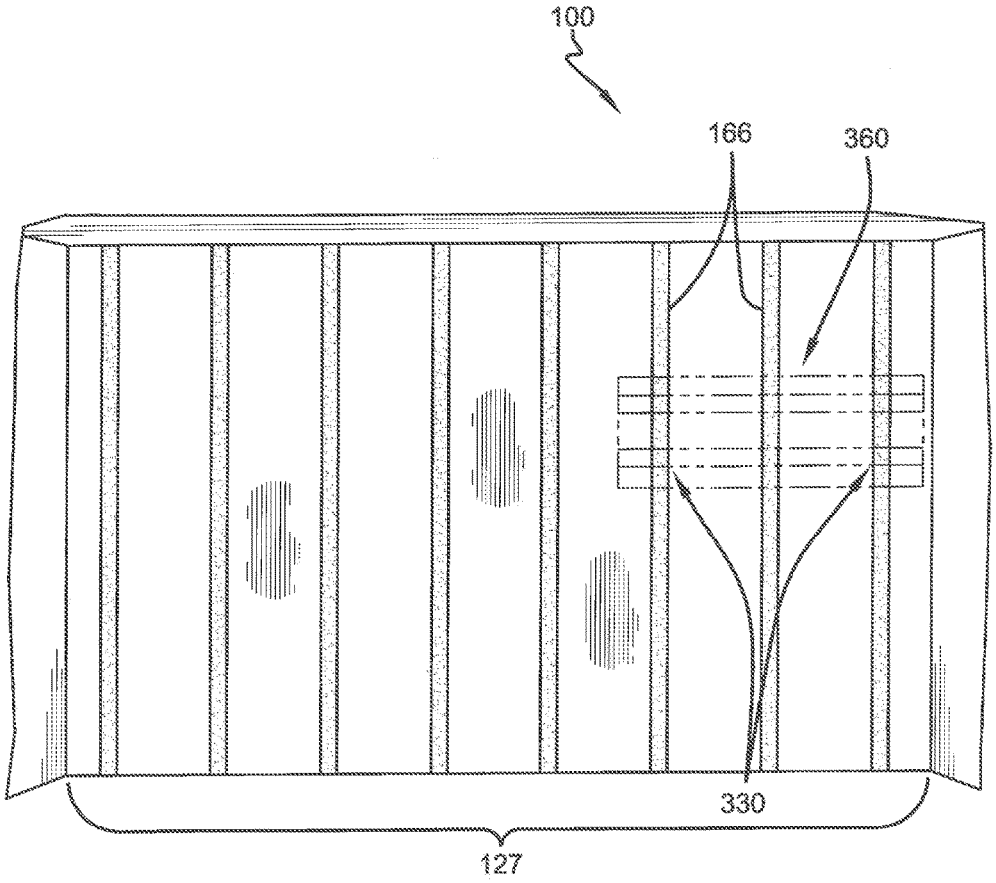
FIG. 4 is a planar view of the wall of FIG. 3 and a transparent view of the backside of the panel of FIG. 2 attached thereon.
Figure 6:
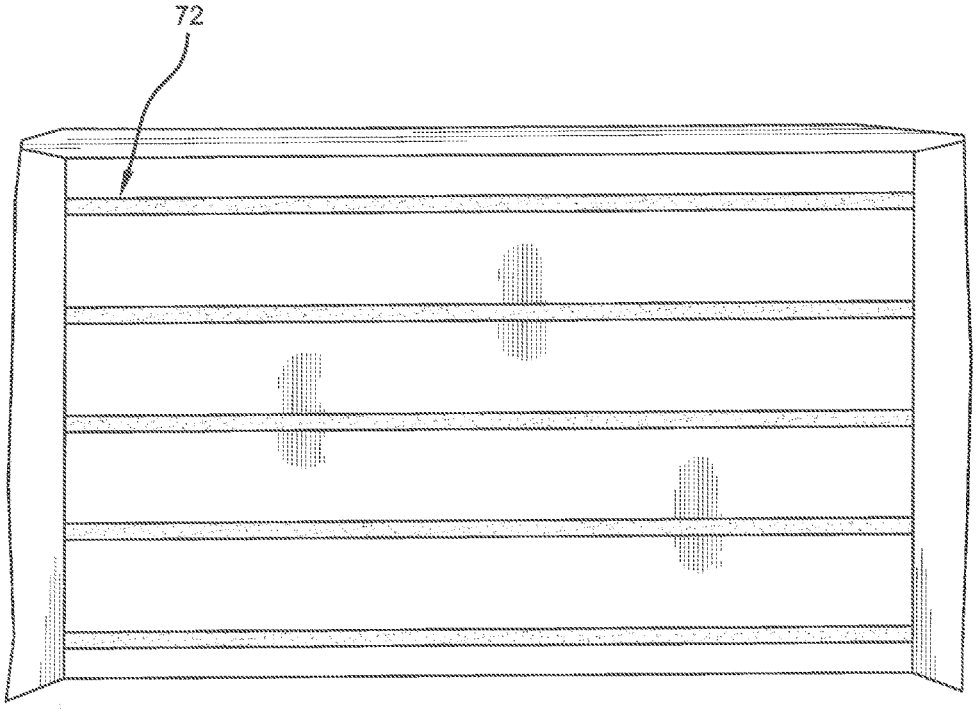
FIG. 6 is a planar view of a further exemplary wall containing a plurality of horizontal fasteners installed thereon.
Figure 7:
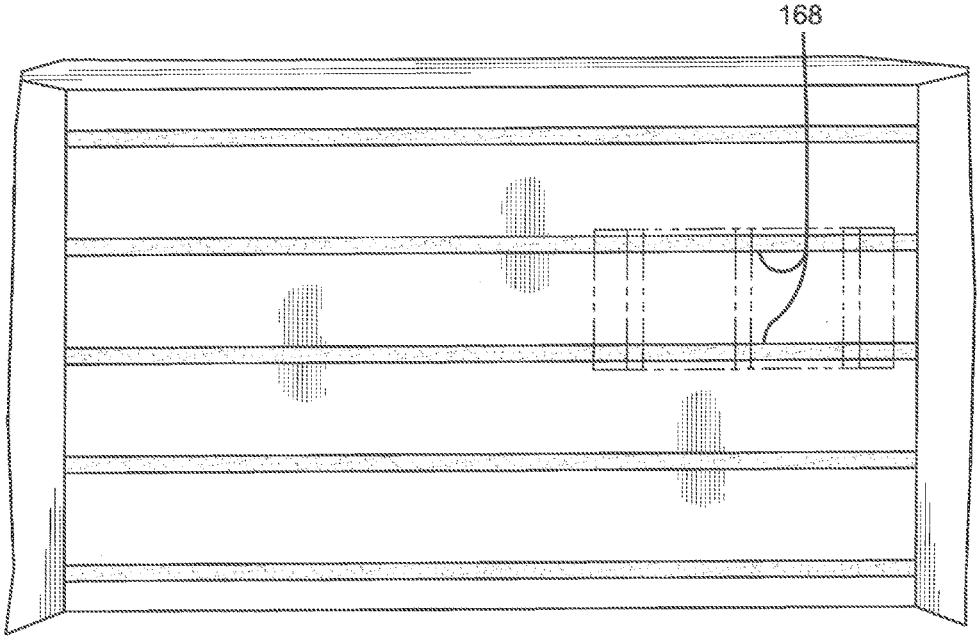
FIG. 7 is a planar view of the wall of FIG. 6 and a transparent view of the backside of the panel of FIG. 5 attached thereon.
Figure 8:
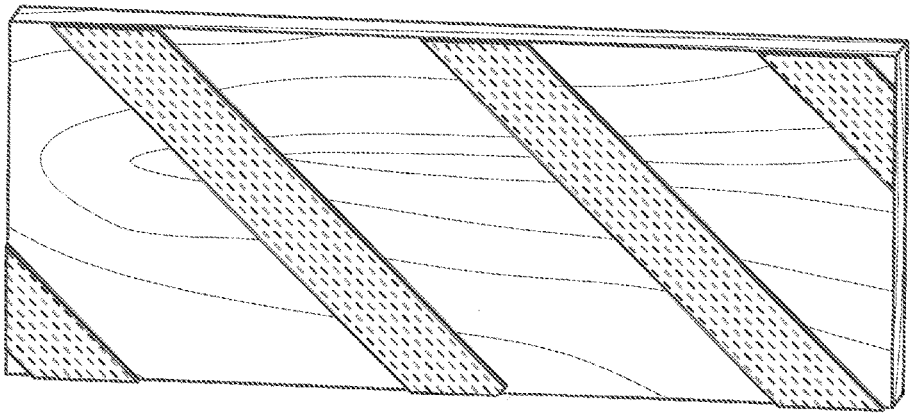
FIG. 8 is a planar view of a back side of a further exemplary rectangular panel.
Figure 9:
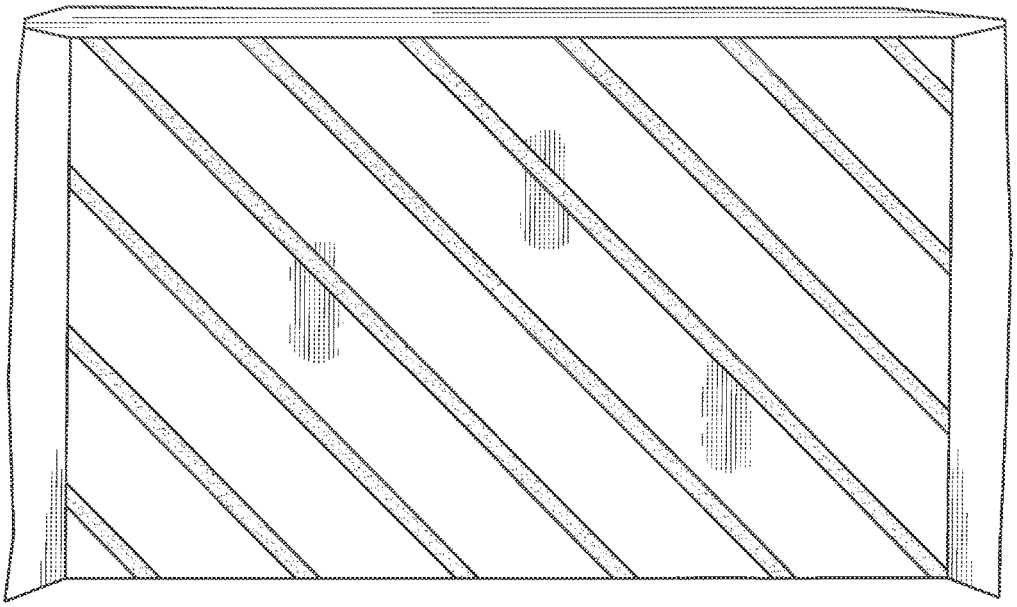
FIG. 9 is planar view of a further exemplary wall containing a plurality of diagonal fasteners installed thereon.
Figure 10:
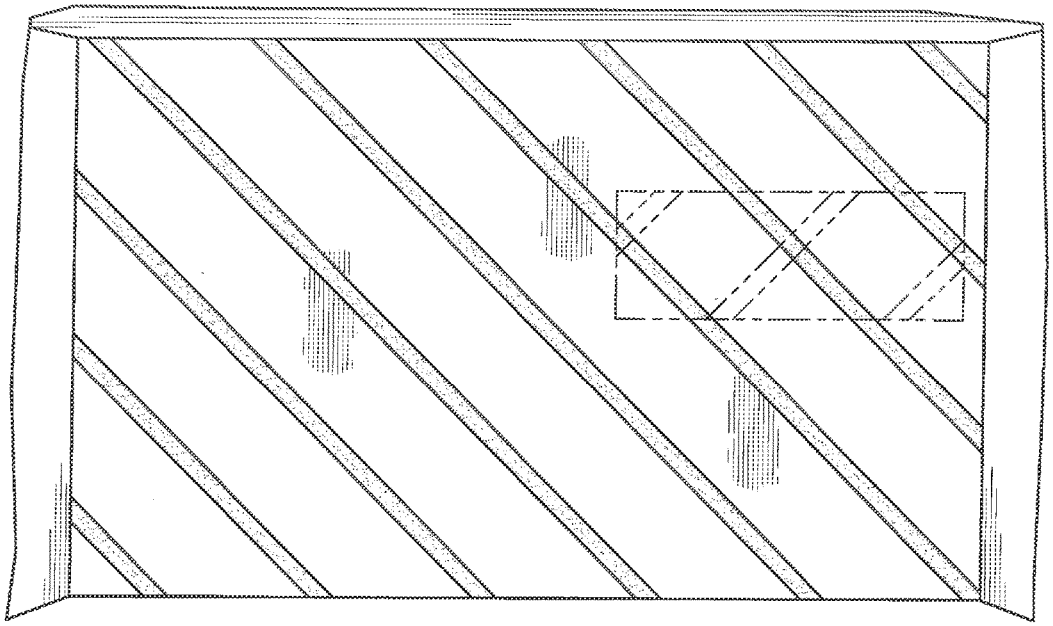
FIG. 10 is a planar view of the wall of FIG. 9 and a transparent view of the backside of the panel of FIG. 8 attached thereon.
Figure 11:
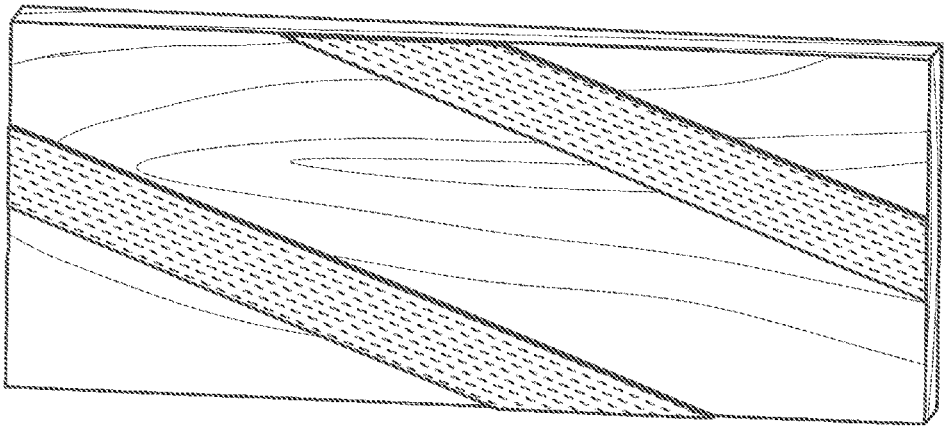
FIG. 11 is a planar view of a back side of a further exemplary rectangular panel.
Figure 12:
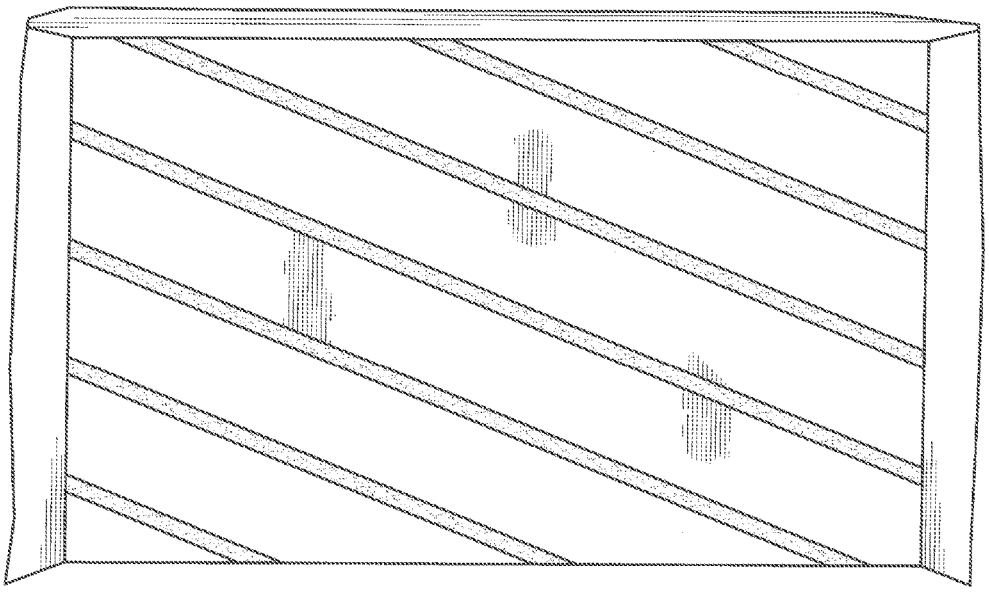
FIG. 12 is a planar view of a further exemplary wall containing a plurality of diagonal fasteners installed thereon.
Figure 13:
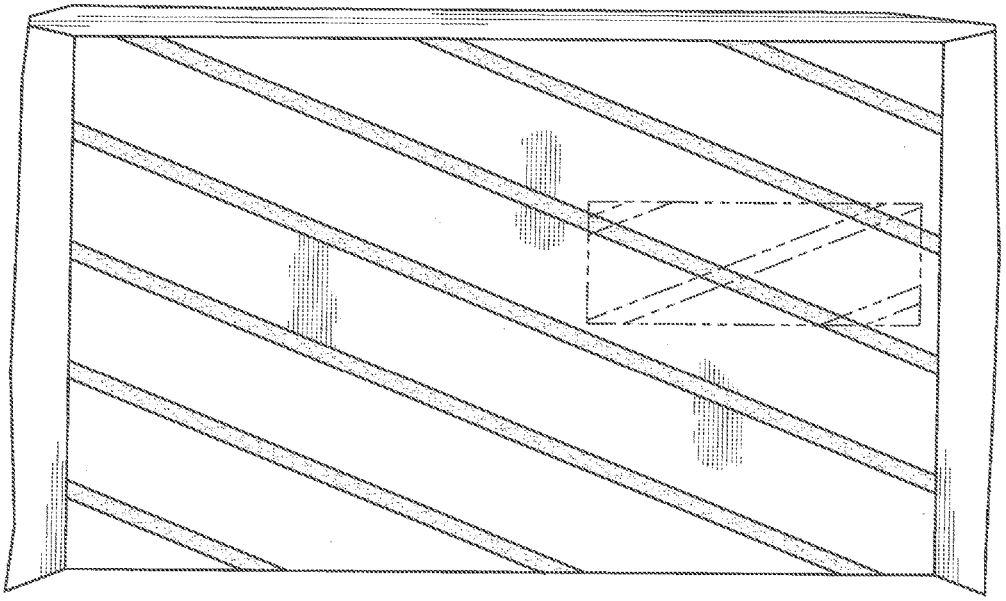
FIG. 13 is a planar view of the wall of FIG. 12 and a transparent view of the backside of the panel of FIG. 11 attached thereon.
Figure 14:
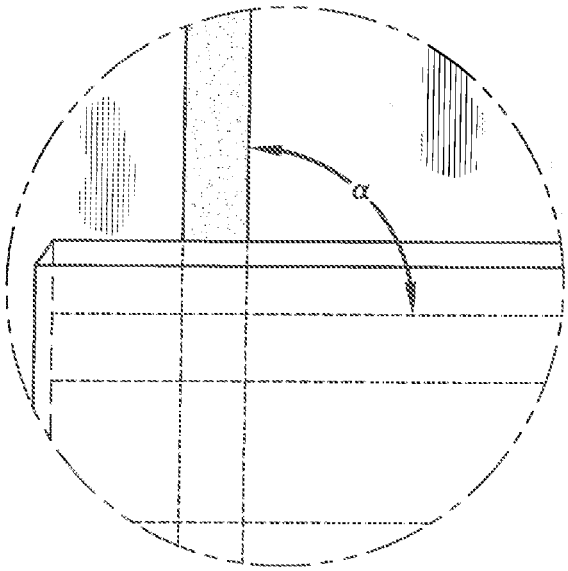
FIG. 14 is a planar view of a transparent panel attached to a wall which shows that the hook and loop fastener may be connected at various angles relative to each other.

As mentioned above, the individual panels 110 of the paneling system 100 may be, in some non-limiting embodiments, rectangular in shape. FIGS. 1, 2, 4, 5, 7, 8, 10, 11, and 13 show rectangular panels 110. It should be understood that a rectangle has certain defined properties including, all angles of the rectangle are equal, alternate sides of the rectangle are equal in length, the rectangle defines two axes of symmetry that bisect opposite sides, and the diagonals of the rectangle are equal in length. It should also be understood that the rectangular panels 110 exhibit the latter recited properties of a rectangle. In the rectangular panel 110 shown in FIG. 1, the two axes of symmetry are a first axis of symmetry 142 and a second axis of symmetry 144. It should further be understood that the rectangular panels 110 shown in FIGS. 1, 2, 4, 5, 7, 8, 10, 11, and 13 are elongated rectangles where one set of opposite sides is longer than the other set of opposite sides. The nature of the elongation of the rectangular panel 110 shown in FIG. 1, may be described without important loss of generality as defining: a first direction 152 coextensive with the first axis of symmetry 142; and a second direction 154 coextensive with the first axis of symmetry 144. As shown in FIGS. 2, 4, 7, 10, and 13, in some embodiments the first fastener 122 may extend parallel to the first direction 152 or at some angle to the first direction 152 where the angle may be between 0 and 90 inclusive. Similarly, as shown in FIGS. 2, 4, 7, 10, and 13, in some embodiments the second fastener 126 may extend parallel to the second direction 154 or at some angle to the second direction 154 where the angle may be between 0 and 90 inclusive. By extension, and as illustrated in FIG. 14, the first fastener 122 and the second fastener 126 may extend at some angle, alpha, to one another. As noted above, alpha may range from about 10 degrees to about 170 degrees. Further, as shown in FIGS. 3, 4, 6, 7, 9, 10, 12, and 13 the substrate 50 may be a wall 52 having some height 82 and length 84. As shown in FIG. 3, in some non-limiting embodiments, the second fastener 126 may be part of a series of second fasteners 127 adhered to the wall 52 in a vertical fashion along at least a portion of the height 82 of the wall 52 to form multiple vertical columns 166. As shown in FIG. 4, in some non-limiting embodiments, the individual panels 110 are adapted to be attached to the wall 52 by a connection 330 established between at least one first fastener 122 on the back side of the panels 110 and two longitudinal columns 166 of second fastener 126 to form a perpendicular connection 330 between the first fastener 122 and the second fasteners 126. As shown in FIG. 6, in some non-limiting embodiments, a series of second fasteners 127 are adhered to the wall in a horizontal fashion along at least a portion of the length 84 of the wall 52 to form a series of horizontal rows 168 of the second fastener 126. As shown in FIG. 7, in some non-limiting embodiments, the individual panels 110 are adapted to be attached to the wall 52 by a connection 330 established between at least one first fastener 122 on the back side 112 of the panels 110 and two horizontal rows 168 of second fastener 126 to form a perpendicular connection 330 between the first fastener 122 and the second fasteners 126.

To remove the panels from the wall, an individual simply pulls on a panel until the hook and loop fasteners disengage from each other. The adhesive on the back sides of the fasteners are sufficiently strong to maintain the adherence of either the hook or loop fastener to the back of the panel and the corresponding hook or loop fastener to the wall during the separation of the panel from the wall. If an individual wishes to remove the entire paneling system from the wall, he or she may simply grab an edge of the hook or loop fastener that is adhered to the wall and pull the fastener off the wall. The pulling action does not cause damage to paint or underlying drywall as the adhesive that secures the fastener to wall is not sufficiently sticky to pull paint off of the wall or to pull the top layer of drywall off.

In some embodiments and situations, the hook material is more expensive than the loop material. In such situations, it may desirable to use embodiments in which the hook material is used more sparingly. In some of the above embodiments effective engagement requires less of the material applied to the back of the panels that of the material applied to the walls such that it is more cost effective to apply the more expensive material to the back of the panels and the more expensive material to the walls.

In some embodiments and situations, application of the hook along the length of the wooden panel consumes much less labor than putting the hook on along the short side of the panel. Such application difference can be exploited to develop embodiments requiring less labor to produce.

While the paneling system has been described above in connection with various illustrative embodiments, it is to be understood that other similar embodiments may be used or modifications and additions may be made to the described embodiments for performing the same function disclosed herein without deviating therefrom. Further, all embodiments disclosed are not necessarily in the alternative, as various embodiments may be combined or subtracted to provide the desired characteristics. Variations can be made by one having ordinary skill in the art without departing from the spirit and scope hereof. Therefore, the paneling system should not be limited to any single embodiment, but rather construed in breadth and scope in accordance with the recitations of the appended claims. The right to claim elements and/or sub-combinations that are disclosed herein as other inventions in other patent documents is hereby unconditionally reserved.

Having thus described the disclosed system and method, it is now claimed:

1. A paneling system for a rigid substrate comprising:
- a plurality of rigid individual panels, each of the panels having a front side, a back side, a top edge, a bottom edge, a first side edge, and a second side edge;
- a first fastener connected to the back side of the individual panels with a permanent pressure adhesive;
- a second fastener connected to the substrate with a second adhesive,
- wherein the individual panels are adapted to be removably installed to the substrate through a connection established between the first fastener and the second fastener;
- wherein the fasteners are adapted to be disconnected without damage by pulling them apart
- wherein the first fastener is elongated in a first direction;
- wherein the second fastener is elongated in a second direction;
- wherein the panels have a thickness ranging from 2 to 6 millimeters;
- wherein the individual panels are rectangular in shape having
  - a length between 25 centimeters and 112 centimeters, and
  - a width of 12.8 centimeters;
- wherein the panels are made of wood; and
- wherein the permanent pressure second adhesive are both the same adhesive which is an emulsion acrylic ultra-removable adhesive having moderate tack on flat smooth surfaces.

2. The paneling system of claim 1,
- wherein the connection between the first fastener and the second fastener is such that there is an angle between the first and second directions within the range of 10 degrees to 170 degrees.

3. The paneling system of claim 2,
- wherein the first fastener comprises a fabric hook fastener and the second fastener comprises a fabric loop fastener; or
- wherein the first fastener comprises a fabric loop fastener and the second fastener comprises a fabric hook fastener.

4. The paneling system of claim 3, wherein the substrate is a wall having some height and some length.

5. The paneling system of claim 4,
- wherein at least one first fastener is adhered to the back side of each individual panel so that the first direction is parallel with the length of the panel.

6. The paneling system of claim 5, wherein a series of second fasteners are adhered to the wall in a vertical fashion along at least a portion of the height of the wall to form multiple vertical columns of the second fastener.

7. The paneling system of claim 6, wherein the individual panels are adapted to be attached to the wall by a connection established between at least one first fastener on the back side of the panels and two longitudinal columns of second fastener to form a perpendicular connection between the first and second fasteners.

8. The paneling system of claim 5, wherein a series of second fasteners are adhered to the wall in a horizontal fashion along at least a portion of the length of the wall to form a series of horizontal rows of the second fastener.

9. The paneling system of claim 8, wherein at least one first fastener is adhered to the back side of each individual panel so as to be parallel with the width of the panel.

10. The paneling system of claim 8, wherein the individual panels are adapted to be attached to the wall by a connection established between at least one first fastener on the back side of the panels and two horizontal rows of second fastener to form a perpendicular connection between the first and second fasteners.

11. The paneling system of claim 4, wherein the second fastener and underlying adhesive are adapted to be removed from the wall without removing paint or causing damage to the wall.

12. A paneling system comprising:
- a plurality of rigid individual panels, each panel having a front side, a back side, a top edge, a bottom edge, a first side edge, and a second side edge;
- a first fastener
  - connected to the back side of each panel with a permanent pressure
  - adhesive, the connection established through the use of an acrylic
  - emulsion ultra-removable adhesive,
  - elongated in a first direction; and
- a second fastener
  - connected to a rigid wall with a permanent pressure adhesive,
  - the connection established through the use of an acrylic emulsion ultra-removable adhesive, elongated in a second direction, wherein each panel is adapted to be removably installed to the wall through a connection established between the first fastener and the second fastener;

wherein the wall has some height and some length;

wherein the first direction and the second direction are at an angle with respect to one another, where the angle is within the range of 10 degrees to 170 degrees;

wherein the first fastener comprises a fabric hook fastener and the second fastener comprises a fabric loop fastener, or wherein the first fastener comprises a fabric loop fastener and the second fastener comprises a fabric hook fastener;

wherein the first fastener and the second fastener are adapted to be disconnected from one another without damage by pulling them apart;

wherein the panels have a thickness ranging from 2 to 6 millimeters;

wherein the individual panels are rectangular in shape having a length between 25 centimeters and 112 centimeters, and a width of 12.8 centimeters;

wherein the panels are made of wood.

13. The paneling system of claim 12, wherein a plurality of second fasteners is adhered to the wall in a vertical fashion along at least a portion of the height of the wall to form multiple vertical columns; and wherein the individual panels are attached to the wall by a connection established between at least one first fastener and two second fasteners to form a perpendicular connection between the first and each of the second fasteners.

14. The paneling system of claim 12, wherein a plurality of second fasteners is adhered to the wall in a horizontal fashion along at least a portion of the length of the wall to form multiple horizontal rows; and wherein the individual panels are attached to the wall by a connection established between at least one first fastener and two second fasteners to form a perpendicular connection between the first and each of the second fasteners.

* * * * *